US005222273A

United States Patent [19]

Favagrossa

[11] Patent Number: 5,222,273

[45] Date of Patent: Jun. 29, 1993

[54] WASHING BRUSH FOR WASHING ROLLERS FOR MOTOR VEHICLE AUTOMATIC WASHING SYSTEMS

[76] Inventor: Francesco Favagrossa, Via Lepanto, 51, 26040 - Roncadello, Italy

[21] Appl. No.: 830,080

[22] Filed: Jan. 31, 1992

[30] Foreign Application Priority Data

Jul. 16, 1991 [IT] Italy ..... 01973 A/91

[51] Int. Cl.[5] ..... A46B 7/10

[52] U.S. Cl. ..... 15/181; 15/179; 15/191.1; 51/330; 51/332; 51/334; 492/40

[58] Field of Search ..... 15/179, 181, 191.1, 15/230, 230.12-230.14, 230.17, 230.19, 231; 29/120, 121.5, 124, 125, 895.21, 895.211, 895.213, 895.23; 51/330, 332, 334, 337; 300/21

[56] References Cited

U.S. PATENT DOCUMENTS

| | | | |
|---|---|---|---|
| 621,131 | 3/1899 | Pfleghar | 15/230 |
| 1,387,627 | 8/1921 | Terry | 15/230.17 |
| 1,928,066 | 9/1933 | Mancuso et al. | 15/179 |
| 3,643,282 | 2/1972 | Lechene et al. | 15/179 |
| 3,755,847 | 9/1973 | Liebscher | 15/179 |
| 4,815,158 | 3/1989 | Crotts | 15/179 |

FOREIGN PATENT DOCUMENTS

| | | | |
|---|---|---|---|
| 482321 | 9/1929 | Fed. Rep. of Germany | 15/230.12 |
| 90717 | 7/1980 | Japan | 15/230.19 |
| 125684 | 5/1928 | Switzerland | 15/191 R |
| 13944 | of 1908 | United Kingdom | 15/230 |

*Primary Examiner*—Harvey C. Hornsby
*Assistant Examiner*—Mark Spisich
*Attorney, Agent, or Firm*—Bucknam and Archer

[57] ABSTRACT

A washing brush for motor vehicle automatic washing system washing rollers comprises a plurality of plate-like elements including sets of bristles, which can be wound about a supporting roller and arranged near one another in an axial direction, each plate-like element including a plurality of cylindric seats for housing therein evenly distributed bristle sets. The main feature of the invention is that each plate-like element is further provided, at an end portion thereof, with a recessed portion devoid of cylindric seats therein can be engaged a middle projection having cylindric seats and provided on the other end portion of the plate-like element, at least a removable coupling element being moreover provided for coupling the mentioned end portions, on one of which there is formed a recessed region for fitting therein the other end portion.

5 Claims, 4 Drawing Sheets

WASHING BRUSH FOR WASHING ROLLERS FOR MOTOR VEHICLE AUTOMATIC WASHING SYSTEMS

BACKGROUND OF THE INVENTION

The present invention relates to a washing brush for washing rollers for motor vehicle automatic washing systems.

As is known, in automatic motor-vehicle washing systems there are conventionally used roller washing brushes which comprise a plurality of bristles which, as the brush roller is rotatively driven, will contact the surface of the motor vehicle so as to remove therefrom dirt and the like.

There are also known, for the intended application, brush rollers which are made of a plurality of plate-like elements, wound about a core roller and arranged adjoining one another in the axial direction.

It has been found that the wear of these rollers occurs mainly at given regions which correspond to the projecting portions of the motor vehicle and an important problem to be solved is that of easily and quickly replacing the worn plate-like elements of the rollers.

Another main problem to be solved is that of easily and simply coupling the bristles to the above mentioned plate-like elements.

In this connection it is to be pointed out that these sets of bristles mainly at given regions where there are provided projecting portions of the motor vehicle, such as mirrors and the like, are subjected to great pulling forces which can detach the bristles from their supporting element.

SUMMARY OF THE INVENTION

Accordingly, the main object of the present invention is to solve the above mentioned problems, by providing a washing brush for motor vehicle automatic washing system washing rollers in which the several plate-like elements forming the brush can be quickly and simply replaced.

Another object of the present invention is to provide a plate-like element for forming washing brushes which, at an end portion thereof, is provided with a recess in which a middle projection including cylindric seats can be easily and quickly fitted so as to afford the possibility of easily and quickly applying each plate-like element on a metal supporting roller by means of only one or two screws, or other equivalent restraining means, instead of using three of four screws, as presently used in prior art washing brush rollers.

Another object of the present invention is to provide such a washing brush which comprises seats so designed and arranged as to firmly restrain the several sets of bristles.

Yet another object of the present invention is to provide such a washing brush which is very reliable in operation and can be easily made starting from easily available elements and materials and which, moreover, is very competitive from a mere economic standpoint.

BRIEF DESCRIPTION OF THE DRAWINGS

Further characteristics and advantages of the invention will become more apparent hereinafter from the following detailed description of a preferred though not exclusive embodiment thereof, which is illustrated, by way of an indicative but not limitative example, in the figures of the accompanying drawings, where.

DESCRIPTION OF THE PREFERRED EMBODIMENTS

With reference to the figures of the accompanying drawings, the washing brush for motor vehicle automatic washing system washing roller according to the present invention, comprises a plurality of plate-like element, generally indicated at the reference number 1 which, advantageously, comprise a comparatively flexible rubber layer 2, thereon there are evenly distributed a plurality of cylindric seats 3 for engaging therein corresponding sets of bristels.

Figure 1:
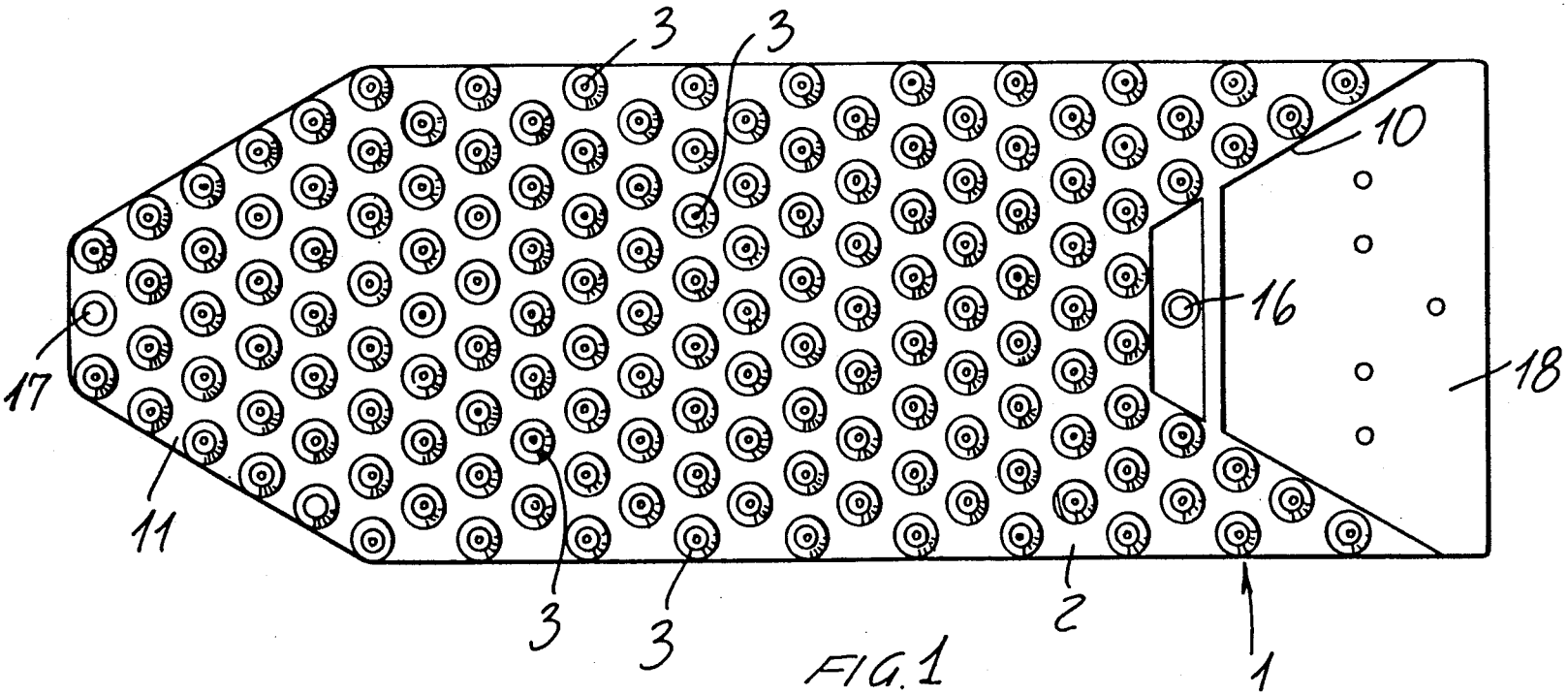
FIG. 1 is a schematic top plan view illustrating a plate-like element included in the washing brush according to the present invention.
Figure 2:
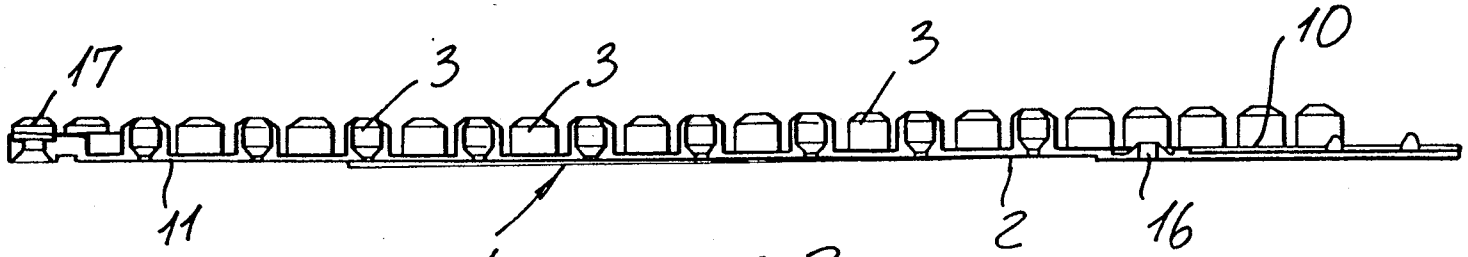
FIG. 2 is a longitudinal cross-sectional view showing the plate-like element represented in FIG. 1.

As clearly shown in FIG. 1, at one end portion of the plate-like element, there is provided a recess 10, of substantially V-shape, said recess being free of the mentioned cylindric seats 3.

At the opposite end portion thereof, the plate-like element 1 has a projection 11 having a shape mating that of the mentioned recess, said projection 11 being engageable with said recess so as to provide a continuous band which can be wound about the washing core roller generally indicated at 15.

In order to perform this connection at the two end portions there are provided two holes 16 and 17 which allow the washing brush forming plate-like elements to be easily affixed, by screw or rivet means, to the core of the supporting metal roller 15*a*.

More specifically, the projection 11 can be engaged in the seat 18 which is formed at said end portion, so as to provide a substantially flush outer surface.

Figure 3:
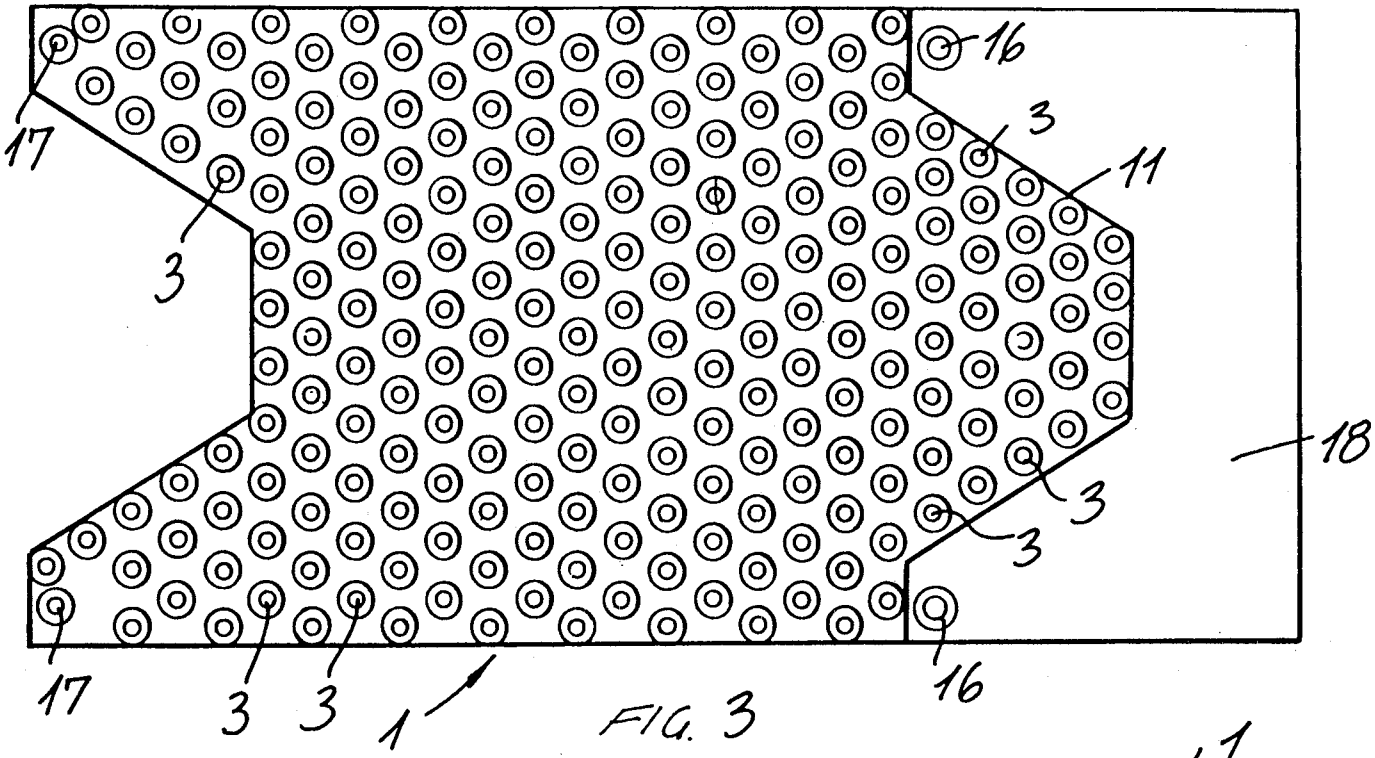
FIG. 3 is a top plan view of another plate-like element of greater width.
Figure 4:
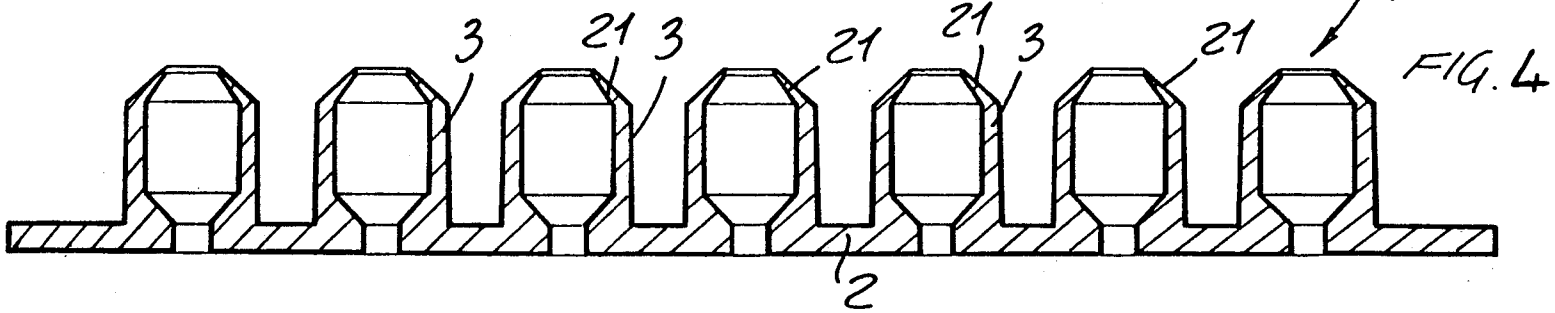
FIG. 4 illustrates, on an enlarged scale, cylindrical seats for housing the washing brush bristles.
Figure 7:
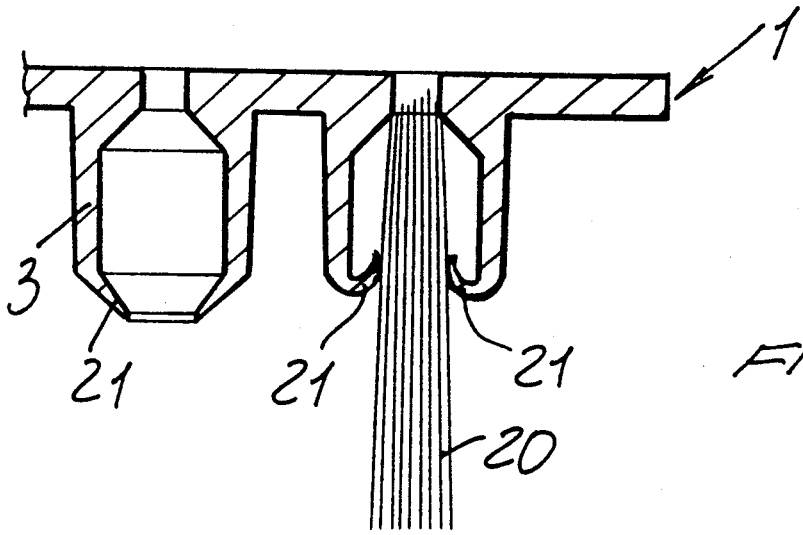
FIG. 7 is a cross-sectional view illustrating the engagement of a bristle set in a cylindric seat.
Figure 6:
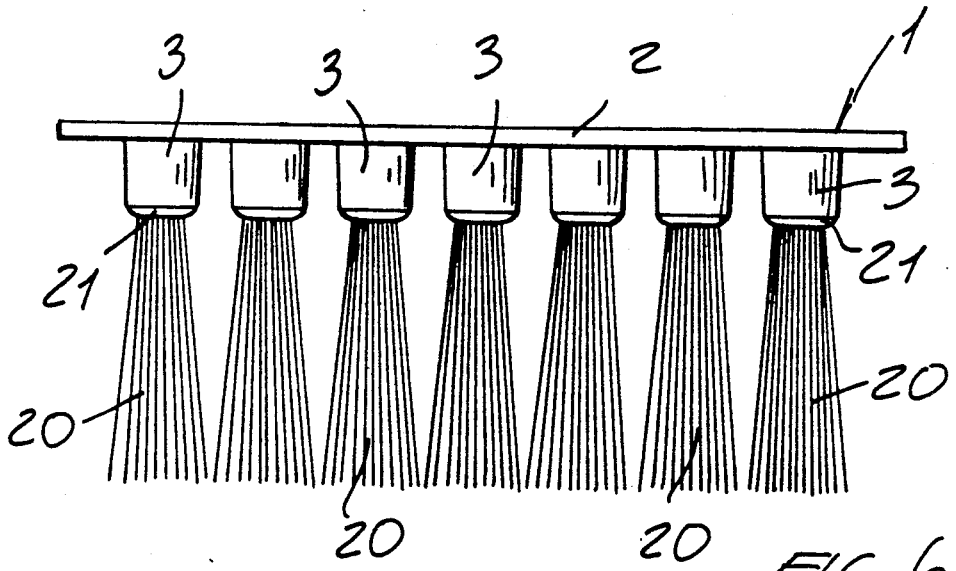
FIG. 6 clearly shows the arrangement of the bristle sets.
Figure 5:
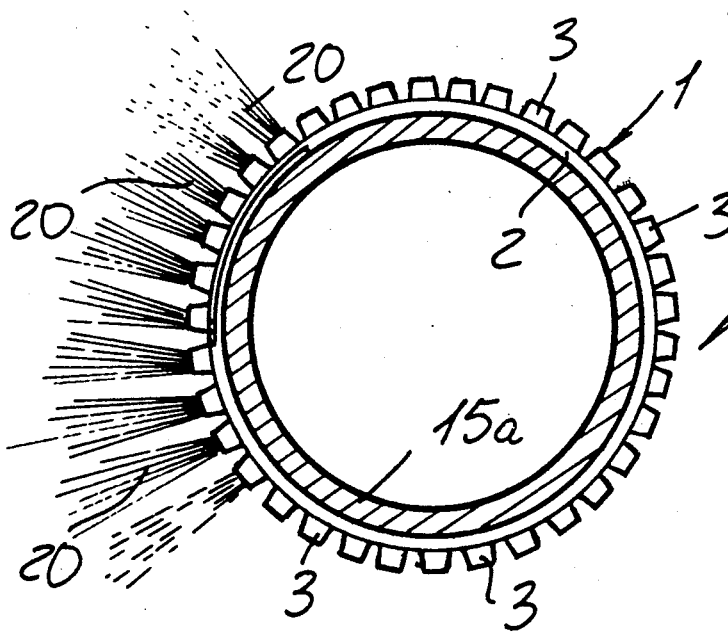
FIG. 5 is a schematic cross sectional view of a roller to which there has been applied a plate-like element for forming a washing brush according to the present invention.
Figure 8:
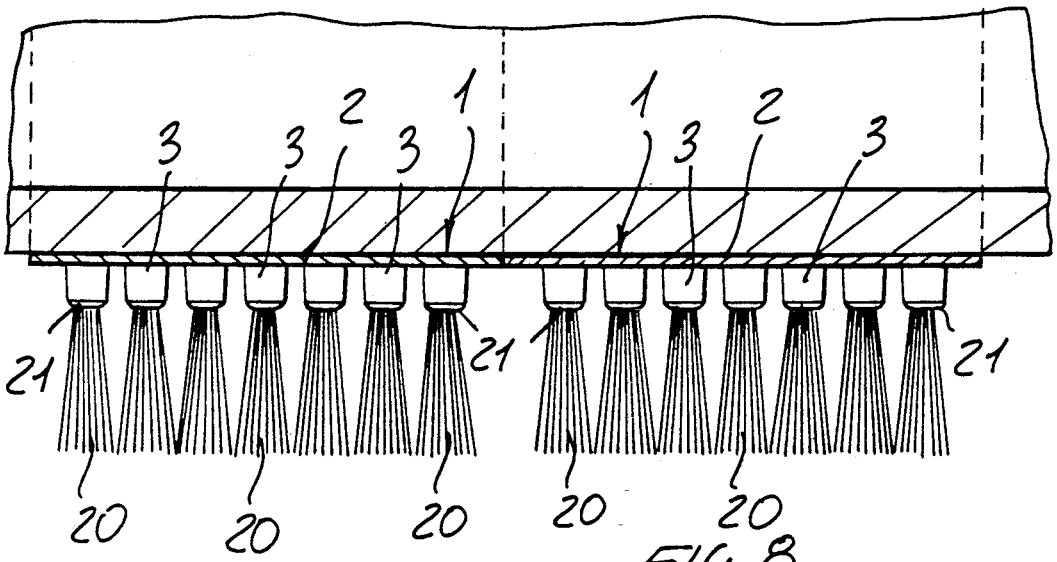
FIG. 8 shows a washing roller and the bristles included therein.
Figure 9:
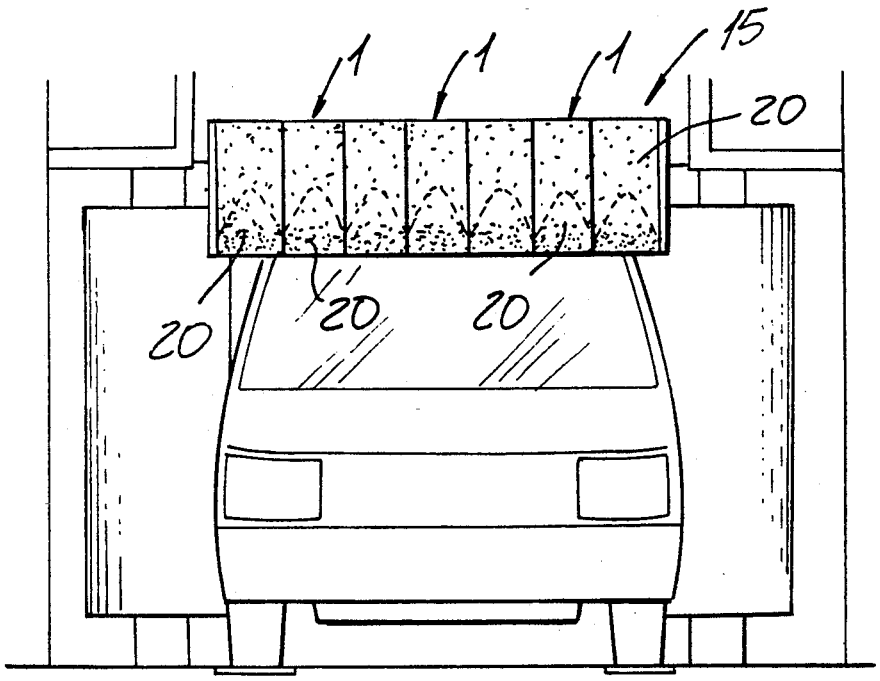
FIG. 9 is a schematic view illustrating a motor vehicle automatic washing system using washing brushes or rollers according to the present invention.

In FIG. 3 there is illustrated a conceptually analogous embodiment, with the single difference that the end portions, i.e. the end portion where is provided the recess, still indicated at 10, and that where is provided the projection 11, are mutually reversed.

Moreover, since the strip or band has an increased width, two coupling elements are provided, comprising a pair of pins 16 which can be correspondingly engaged in respective coupling seats 17 formed at the other end portion.

With this arrangement the several plate-like elements can be applied to the roller 15 in a very quick and simple way, with the advantage that an worn plate-like element can be easily and quickly removed from said roller.

Another very important feature of the present invention is that the bristle sets, indicated at 20, are engaged in their cylindric seats in a very firm way, so as to properly resist against pulling forces.

To that end, the cylindric seats 3 are provided, at their open portion, with a tapering lip 21, made of a comparatively flexible material which, as the bristles 20 are engaged in their seats, will be inwardly deflected so as to provide an element adapted to radially press the bristles and to operate as a restraining means restraining the bristles against possible pulling forces.

Moreover, the provision of the above mentioned lip elements 21 also affords the possibility of making a washing brush which does not present any sharp corner to the surface of the motor vehicle being washed.

From the above disclosure it should be apparent that the invention fully achieves the intended objects.

In particular, the fact is to be pointed out that a washing brush or roller has been provided in which the plate-like elements can be quickly and easily replaced.

Another important aspect of the present invention is that the bristles are firmly restrained in their cylindric seats, since they are greatly pressed, at the attachment region thereof, by the mentioned tapering lips 21, which are inwardly deflected, as the sets of bristles are applied.

While the invention has been disclosed and illustrated with reference to preferred embodiments thereof, it should be apparent that the disclosed embodiments are susceptible to several modifications and variations, all of which will come within the spirit and scope of the appended claims.

I claim:

1. A brush for use in automatic vehicle washing systems comprising a cylindrical roller core having, along its longitudinal axis and on its outer surface, a plurality of brush elements located adjacent to each other wherein each brush element is wrapped around said outer surface of said roller, each of said brush elements comprising a flexible plate-like base member having first and second opposite sides, the first side being adapted to be placed on said outer surface and the second side having a plurality of cylindrical seats with brushes fixed in and extending outwardly therefrom, said second side of said base member having a first end which has a recessed portion and is free of said cylindrical seats, said first side of said base member having an end opposite said first end which defines a projection adapted to be wrapped around said roller and to mate with the recessed portion of the second side whereby said second end overlaps said first end and said projection fits within said recessed portion to form a continuous band around said roller core, at least one removable coupling element for coupling the first and second end of said base member to secure each of said brush elements to said roller.

2. The washing brush according to claim 1, wherein said recessed portion has a substantially V-shape and said projection has a shape mating with said V-shape of said recessed portion.

3. The washing brush according to claim 1, wherein said coupling element comprises a pin provided at one of said first and second ends, said pin being removably engaged in a coupling seat provided at said other of said first and second ends.

4. The washing brush according to claim 3, wherein each of said brush elements has a longitudinal middle line and said pin and coupling seat are disposed on said longitudinal middle line.

5. A washing brush according to claim 1, wherein said cylindrical seats have a tapering lip, each of said lips being adapted to press the respective bristles to firmly restrain said bristles in said cylindrical seat.

* * * * *